US008403187B2

(12) United States Patent
La Sorda

(10) Patent No.: US 8,403,187 B2
(45) Date of Patent: Mar. 26, 2013

(54) PRODUCTION OF AN INERT BLANKET IN A FURNACE

(75) Inventor: Terence D. La Sorda, Norristown, PA (US)

(73) Assignee: Air Liquide Industrial U.S. LP, Houston, TX (US)

( * ) Notice: Subject to any disclaimer, the term of this patent is extended or adjusted under 35 U.S.C. 154(b) by 1373 days.

(21) Appl. No.: 11/829,114

(22) Filed: Jul. 27, 2007

(65) Prior Publication Data

US 2008/0182022 A1 Jul. 31, 2008

Related U.S. Application Data

(60) Provisional application No. 60/827,122, filed on Sep. 27, 2006.

(51) Int. Cl.
*B22D 37/00* (2006.01)

(52) U.S. Cl. ..... 222/603; 266/242

(58) Field of Classification Search ..... 266/242; 222/603; 432/64

See application file for complete search history.

(56) References Cited

U.S. PATENT DOCUMENTS

| | | | |
|---|---|---|---|
| 3,400,752 | A | 9/1968 | Unsworth |
| 3,443,806 | A | 5/1969 | Galey et al. |
| 3,484,232 | A | 12/1969 | Karinthi et al. |
| 3,598,168 | A | 8/1971 | Clark |
| 3,619,172 | A | 11/1971 | Lutgen et al. |
| 3,640,702 | A | 2/1972 | Karinthi et al. |
| 3,664,652 | A | 5/1972 | Spire et al. |
| 3,689,048 | A | 9/1972 | Foulard et al. |
| 3,743,500 | A | 7/1973 | Foulard et al. |
| 3,868,987 | A | 3/1975 | Galey et al. |
| 4,059,424 | A | 11/1977 | Bentz |
| 4,087,899 | A | 5/1978 | Chevalier et al. |
| 4,089,678 | A | 5/1978 | Hanawalt |
| 4,093,553 | A | 6/1978 | Galey et al. |
| 4,178,980 | A | 12/1979 | Gilbert et al. |
| 4,181,522 | A | 1/1980 | Galey et al. |
| 4,211,269 | A | 7/1980 | Bentz et al. |
| 4,236,913 | A | 12/1980 | Austin |
| 4,460,409 | A | 7/1984 | Devalois et al. |
| 4,519,438 | A | 5/1985 | Grosso et al. |
| 4,549,598 | A | 10/1985 | Gervais et al. |
| 4,565,234 | A | 1/1986 | Rimbert |
| 4,614,216 | A | 9/1986 | Savard et al. |
| 4,657,587 | A | 4/1987 | Savard et al. |
| 4,791,977 | A | 12/1988 | Chandley |
| 4,806,156 | A | 2/1989 | Anderson et al. |

(Continued)

FOREIGN PATENT DOCUMENTS

| | | |
|---|---|---|
| CA | 969323 | 6/1975 |
| CA | 973366 | 8/1975 |

(Continued)

OTHER PUBLICATIONS

PCT/IB2007/002738, International Search Report, Jan. 28, 2008, 4 pgs.

*Primary Examiner* — Scott Kastler
(74) *Attorney, Agent, or Firm* — Allen E. White

(57) ABSTRACT

A system for delivering a fluid into a container includes a housing configured to be secured to the container. The housing includes a reservoir to receive and retain a fluid as a liquid, and the housing further includes an opening that provides fluid communication between the reservoir and an interior within the container so as to facilitate a flow of inert gas which is formed from vaporization of the liquid within the reservoir into the container interior.

32 Claims, 3 Drawing Sheets

U.S. PATENT DOCUMENTS

| | | | | |
|---|---|---|---|---|
| 4,828,609 | A | | 5/1989 | Anderson et al. |
| 4,848,751 | A | | 7/1989 | Lutgen et al. |
| 4,962,291 | A | | 10/1990 | Fujita et al. |
| 5,366,409 | A | * | 11/1994 | Riley ..... 432/64 |
| 5,404,929 | A | | 4/1995 | Till |
| 5,518,221 | A | * | 5/1996 | Zurecki et al. ..... 222/603 |
| 6,228,187 | B1 | | 5/2001 | Till |
| 6,491,863 | B2 | | 12/2002 | Jepson |
| 6,508,976 | B2 | | 1/2003 | Till |

FOREIGN PATENT DOCUMENTS

| | | | | |
|---|---|---|---|---|
| DE | 1164605 | | | 3/1964 |
| DE | 2841186 | | | 4/1979 |
| DE | 19518554 | | | 11/1996 |
| EP | 0089282 | B1 | | 9/1983 |
| EP | 0300907 | A1 | | 1/1989 |
| EP | 0387107 | A2 | | 9/1990 |
| EP | 0715142 | A1 | | 6/1996 |
| GB | 220279 | | | 2/1925 |
| GB | 987190 | | | 3/1965 |
| GB | 1372801 | | | 11/1974 |
| GB | 2004784 | A | * | 4/1979 |
| GB | 2092037 | | | 8/1982 |
| JP | 58020369 | | | 2/1983 |
| JP | 5211926 | | | 8/1993 |
| JP | 8103953 | | | 4/1996 |
| WO | WO 8000137 | | | 2/1980 |

* cited by examiner

PRODUCTION OF AN INERT BLANKET IN A FURNACE

CROSS-REFERENCE TO RELATED APPLICATIONS

This application claims priority from U.S. Provisional Patent Application Ser. No. 60/827,122, entitled "Method for Producing an Inerting Blanket in a Furnace," and filed Sep. 27, 2006. The disclosure of this provisional patent application is incorporated herein by reference in its entirety.

BACKGROUND

1. Field

The disclosure pertains to forming an inert blanket of a cryogenic fluid at the surface of a molten metal bath within a furnace.

2. Related Art

In foundry melting operations, metals (ferrous or non-ferrous) are typically melted in electric induction furnaces. It is often advantageous to melt the metals under cover of inert gas (such as argon, nitrogen or carbon dioxide) so as to minimize or prevent exposure of the molten metal to oxygen and resultant oxidation of the metal to form metallic oxides that are deleterious to cast metal products formed from the molten metal. The inert gas cover also reduces the tendency of the molten metal to absorb gases (e.g., oxygen and hydrogen) from the atmosphere, which in turn reduces gas-related casting defects such as porosity. Other benefits of melt surface inerting include reduced slag formation, improved metal fluidity, increased furnace refractory life, and reduced need for de-oxidizers.

Electric induction furnaces are generally open-top, batch melting units. The inert gas is typically applied from this open top throughout the entire melting process. A number of different furnace inerting techniques are utilized. The two main techniques involve blowing the inert gas into the top of the furnace and dripping or pouring inert liquid (in cryogenic form) into the furnace at the open top. In certain liquid inerting techniques, an inert layer of liquid argon or liquid nitrogen is formed over the entire molten metal surface to blanket the metal from oxygen and other gases.

Liquid inerting is often desirable over gas inerting, since the liquid has a higher density than the gas and therefore is more likely to stay at or near the molten metal surface rather than being forced upward due to thermal updrafts within the furnace. However, utilizing a cryogenic liquid to provide the entire blanketing or inert layer over the molten metal surface requires a significant amount of the cryogenic liquid to maintain the blanket throughout the process, and this can result in significant and excessive increase in operating costs.

In addition, the use of liquid inerting by direct application of a cryogenic liquid directly to the molten metal surface can lead to spitting or blow out of molten metal from the furnace upon contact of the cold liquid to the hot metal surface. This can be particularly dangerous to the furnace operator, particularly in furnaces in which a high meniscus profile has developed for the molten metal with in the furnace.

It would be desirable to provide a system that is capable of achieving an effective inert layer over a molten metal surface in a furnace while minimizing the amount of inert substance that is required and thus reducing operating costs associated with the melting process.

SUMMARY

A system for delivering a fluid into a container is described herein. The system comprises a housing configured to be secured to the container and including a reservoir to receive and retain a fluid as a liquid. The housing further includes an opening that provides fluid communication between the reservoir and an interior within the container so as to facilitate a flow of gas which is formed from vaporization of the liquid within the reservoir into the container interior.

In an exemplary embodiment, the system housing comprises a collar including an opening extending through the collar between a top end and a bottom end of the collar, and a channel defined within an interior of the collar near the bottom end, where the channel is annular or substantially annular in shape and is in fluid communication with the opening. An inlet port is also provided which is configured to receive the fluid as a liquid and deliver the fluid into the annular channel.

In a further exemplary embodiment, the system is configured for use with a container such as a furnace (for example, an induction furnace) that processes molten metal, where the system delivers the fluid vapor into the container to form an inert blanket or layer over the molten metal surface within the container. In such a system, the collar is secured to an open, top end of the container so as to facilitate the travel of vapor into the container and toward the molten metal surface.

The system can include a number of different features including, without limitation, any one or combination of the following features:

- the bottom end of the collar includes an interior surface that extends upward toward the top end of the collar so as to form a lip having an end that terminates between the top and bottom ends, and the lip defines a portion of the annular channel;
- the inlet port comprises an elongated pipe extending transversely from an exterior side wall portion of the collar;
- a lance pipe that is connected with the inlet port, where the pipe is configured to deliver the fluid in the form of a liquid through the inlet port and into the collar;
- a fluid source connected with the lance pipe, where the fluid source optionally contains at least one of liquid argon, liquid nitrogen and liquid carbon dioxide;
- the collar has a continuous, annular shape that defines a corresponding continuous, annular shape for the channel;
- the collar is curved and has a C shape with two terminal ends proximate each other so as to define a corresponding C shape for the channel; and
- at least one of the collar and the inlet port is constructed of one or more materials comprising stainless steel.

In another embodiment, a system for delivering a fluid into a container comprises a means for receiving the fluid as a liquid and for delivering the fluid into the container as a vapor, and an inlet port configured to provide the fluid as a liquid to the means for delivering the fluid into the container.

In an exemplary embodiment, the means for receiving the fluid as a liquid and for delivering the fluid into the container as a vapor is configured to deliver the vapor into the container such that the vapor has a shape that conforms and corresponds with a major portion of a cross-sectional shape defined by interior peripheral wall portions of the container (e.g., where the major portion is at least 50% of the transverse cross-sectional area of the interior surface of the container).

In a further exemplary embodiment, the means for receiving the fluid as a liquid and for delivering the fluid into the container as a vapor is configured to deliver the vapor into the container in an annular or substantially annular shape.

A method of providing a vapor blanket over a material processed within a container is also described herein. The method comprises delivering a fluid as a liquid into a housing disposed proximate an opening in the container, where the housing is configured to facilitate vaporization of the liquid to form a continuous flow of vapor from the housing into the container, and facilitating a downward flow of the vapor within the container toward the material being processed within the container. The vapor formed from the fluid in the housing is inert with respect to the material being processed within the container.

In an exemplary embodiment, the method further comprises delivering a fluid to the container that vaporizes to form a continuous flow of vapor into the container, where the vapor forms an annular or substantially annular shape within the container, and the vapor comprises a gas that is inert with respect to the material being processed within the container. The method further comprises facilitating a downward flow of the vapor within the container toward the material being processed within the container, where the vapor is configured to expand as the vapor flows toward surface portions of the material in the container so as to form a vapor layer at a location proximate the material that substantially covers the surface portions of the material.

The method can include a number of different features including, without limitation, any one or combination of the following features:

- the continuous flow of vapor is provided within the container using a collar that is disposed at a top end of the container, the collar includes an opening extending through the collar between a top end and a bottom end of the collar, and an annular or substantially annular channel defined within an interior of the collar near the bottom end, where the channel is in fluid communication with the opening, and the method further comprises injecting the fluid as a liquid into the channel via an inlet port that is connected with the collar, where the fluid vaporizes to form the annular or substantially annular shaped vapor that flows into the container;
- the bottom end of the collar includes an interior surface that extends upward toward the top end of the collar so as to form a lip having an end that terminates between the top and bottom ends, the lip defines a portion of the annular channel, and the vapor passes over the lip and flows into the container;
- the collar has a continuous, annular shape that defines a corresponding continuous, annular shape for the channel;
- the collar is curved and has a C shape with two terminal ends proximate each other so as to define a corresponding C shape for the channel;
- the fluid is injected into the channel with a lance pipe that is connected with the inlet port;
- providing the fluid as a liquid to the lance pipe via a fluid supply source, where the fluid supply source optionally contains at least one of liquid argon, liquid nitrogen and liquid carbon dioxide;
- the container comprises an induction furnace, and the material comprises molten metal; and
- at least one of the collar and the inlet port is constructed of one or more materials comprising stainless steel.

The above and still further features and advantages will become apparent upon consideration of the following detailed description of specific embodiments thereof, particularly when taken in conjunction with the accompanying drawings wherein like reference numerals in the figures are utilized to designate like components.

DETAILED DESCRIPTION

Figure 1:
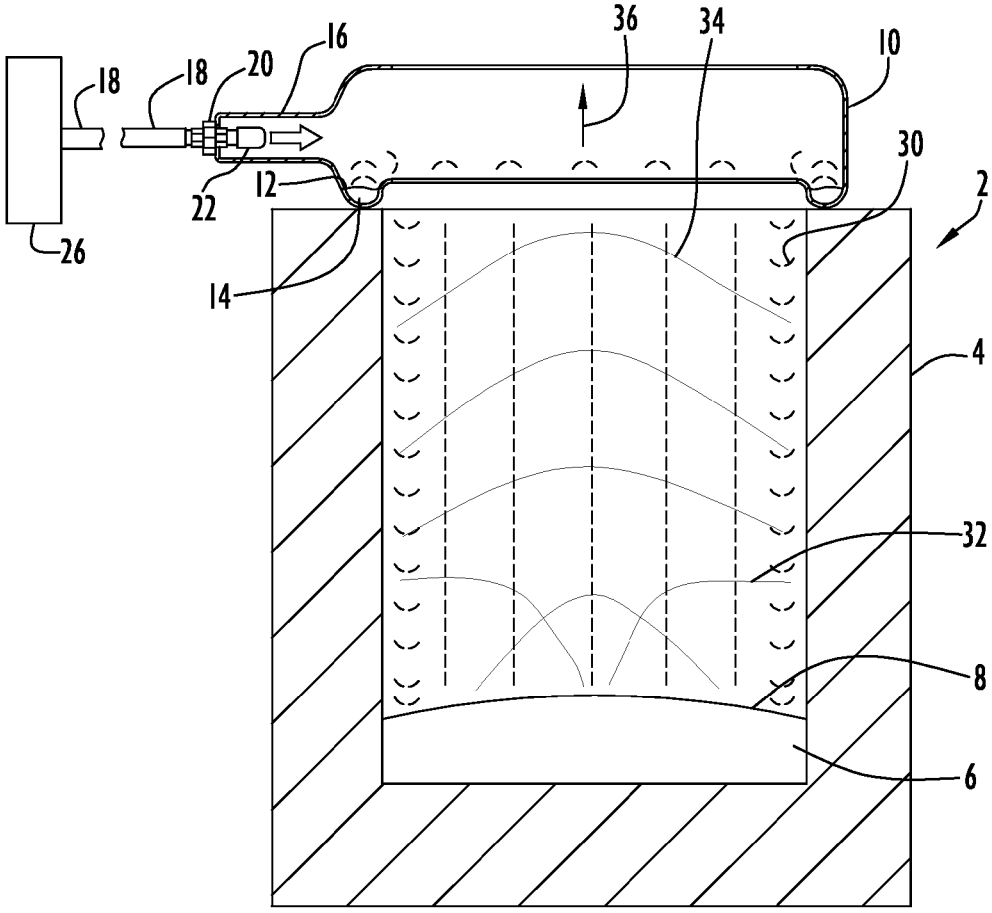
FIG. 1 is schematic view in cross-section of a molten metal furnace including a collar disposed at the top end of the furnace which facilitates the formation of an inerting layer over the molten metal surface within the furnace.

A system is described herein for providing an inert blanket or layer of a gas at the surface of a molten metal material within a container such as a furnace, molten metal bath and/or molten metal transfer system (e.g., a ladle, a launder, etc.). The system can be utilized for any ferrous (e.g., steel) or non-ferrous (e.g., aluminum) melting process. In addition, the system can further be utilized for any process in which it is desired to create an inert cover, blanket or layer directly above a surface of any molten material or other product within a container so as to minimize or substantially prevent oxygen and/or any other gases from coming into contact with, reacting with and/or becoming absorbed within the product being processed within the container.

The gas utilized to create the inert or blanketing layer in the system is inert and non-reactive with respect to the molten metal or other material within the furnace or container. For example, the inert gas for use in molten metal furnaces or containers can be argon, nitrogen, carbon dioxide or combinations thereof. Argon is the preferred inert gas, because it expands many more times from its liquid state into its gaseous state and is heavier than air in relation to nitrogen and carbon dioxide.

The system is configured to include any suitable housing, mold, vessel or other structure that is secured or securable to a container (e.g., a furnace) and includes a reservoir to hold a suitable amount of a liquid cryogen, where the liquid cryogen vaporizes within the structure to form the inert gas for use in the container. The structure further includes an opening that is in communication with the reservoir and provides an exit for the inert gas to leave the structure and fall within the container toward the surface of a material being treated within the container so as to cover or blanket the material surface.

In an exemplary embodiment, the system includes any suitable structure that is capable of generating a substantially annular or ring shaped vapor of the inert gas for delivery into the container, where the inert vapor ring travels along or proximate internal peripheral wall portions of the container toward the surface of the product (e.g., molten metal material) within the container. Preferably, the system comprises an annular or substantially annular shaped member or collar that is suitably dimensioned to fit over an open top end of a container and is connected with a supply of a cryogenic liquid that vaporizes within the collar to substantially form an annulus or ring of inert gas that drops from the collar into the container and expands to form the inert blanket over the surface of the product within the container.

The collar can have a continuous annulus or ring shape or, alternatively, the collar can be formed from one or more discontinuous and separated sections but having a substantially annular shape (e.g., the collar can have a "C" shape or be formed from two separate sections, three separate sections, or even more separate sections that generally define a ring shaped member as noted below), such that the gas that forms from the collar has a substantially annular or ring shape. Thus, the system can include any suitable structure that is capable of delivering an annular or substantially annular shaped flow of inert gas from the top of the container toward the product within the container.

However, as noted above, it is not required that the system be configured to provide an annular or substantially annular shaped flow of gas. Rather, the system can provide inert gas in any shape from a reservoir or pool of cryogenic liquid that is supported within the structure and is permitted to vaporize and emerge from the structure as the inert gas that flows downward into the container.

The system is particularly suitable for use with open top furnaces in which molten metal is formed and processed within the furnace or container. An exemplary container with which the system can be used is an induction furnace (e.g., a rollover induction furnace or a small induction furnace), in which heating coils are provided around a crucible or container that houses the metal so as to heat the crucible to a suitable temperature to achieve a molten metal product within the crucible.

Figure 2:
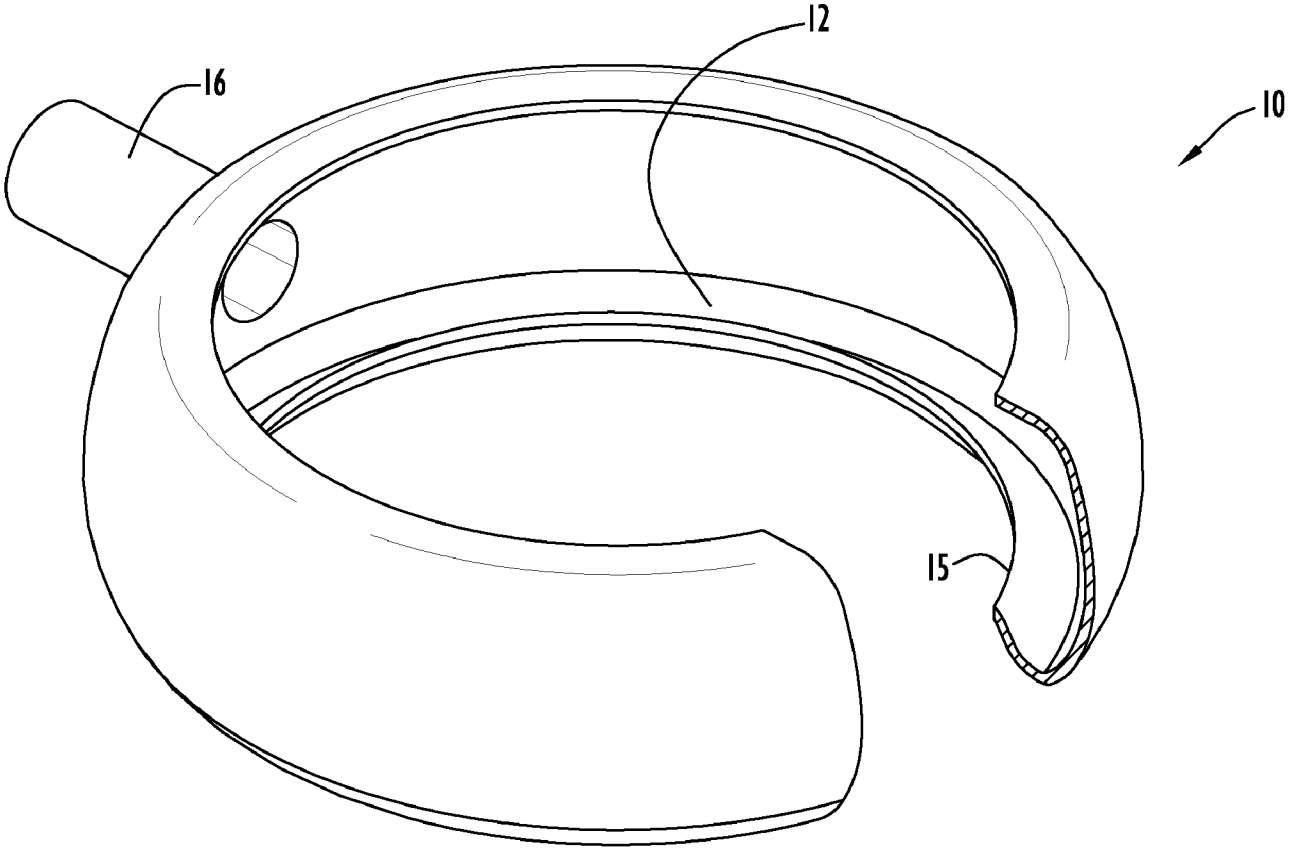
FIG. 2 is a view in perspective of the collar of FIG. 1, with a portion of the collar cut away.

An exemplary embodiment of system for providing a blanket or layer of inert gas over a molten metal surface is now described with reference to FIGS. 1 and 2. A system 2 includes a container in the form of a furnace 4 (e.g., a conventional induction furnace) with an open top configured to receive and heat a metal product so as to form a molten metal material 6 within the furnace. The furnace 4 includes a crucible 5 configured to receive and retain the metal product and a lining 7 surrounding crucible so as to insulate and retain heat within the furnace. The lining can further include heating coils (not shown) as in the case of a conventional induction furnace to facilitate heating of the furnace during operation.

Depending upon the size of the furnace, a meniscus can form at the molten metal surface (e.g., the curved and convex surface 8 of the molten metal material 6 as shown in the figure) during operation, resulting in a relatively short distance between the opening at the top of the furnace and portions of the molten metal surface. In situations in which a cryogenic liquid such as argon is provided into the furnace to form an inert liquid blanket over the molten metal surface, there is a greater potential for "spitting" or over-flow of molten metal from a furnace (e.g., during contact of the cryogenic liquid with the hot metal surface) in which a high meniscus profile of the molten metal surface is formed.

An apparatus for generating an inert blanket over the molten metal surface is provided at the open top end of the furnace in the form of a collar 10. The collar can be formed of stainless steel and/or any other material that is suitable for operation with a furnace and further for receiving and processing cryogenic liquids. The collar 10 has a generally annular or ring-like configuration, including a central opening that extends through the collar between top and bottom ends of the collar and is defined by interior wall portions of the collar. A lower exterior wall portion of the collar extends around the bottom end to an interior wall portion extending upward toward the top end and terminating a selected distance from the bottom end so as to form a lower interior lip 15 between the bottom and top ends. The exterior and interior wall portions at the bottom of the collar are separated from each other to define an annular trough or channel 12 at the bottom end. The channel 12 is configured as a reservoir to receive and retain a cryogenic liquid which is injected through the collar and into the channel in the manner described below. In addition, the channel 12 is in fluid communication with the opening in the collar, such that inert gas formed from the vaporizing liquid in the channel passes over lip 15 and through the collar opening so as to pass into the furnace in the manner described below. The dimensions and cross-sectional profile of the channel can be of any suitable sizes and shapes. For example, the cross section of the channel can have a "J" shape in which the vertical portion of the "J" shape terminates at the lip and has a height from about 3 inches (about 7.6 cm) to about 5 inches (about 12.7 cm) and the lower cross-sectional portion of the "J" shape can have a dimension of about 1 inch (about 2.5 cm) to about 1.5 inches (about 3.8 cm). The channel is further suitably dimensioned and configured to prevent flow of liquid at a level that is below the height of the lip 15 from flowing into the container, such that substantially only inert gas (which vaporizes from the liquid) is flowing into the container.

The collar is suitably sized so as to fit over the opening at the top of furnace 4 such that the central opening of the collar is aligned (preferably coaxially aligned) to communicate with the furnace opening. Typically, conventional induction furnaces are sized having inner diameters in the range of about 2 inches (about 5 cm) to about 10 inches (about 25 cm). The collar is preferably suitably dimensioned to have an inner diameter (as defined by opposing upwardly curving internal wall portions at the bottom end of the collar) that falls within this range. In particular, the collar can be suitably sized to have an inner diameter that substantially corresponds with the inner diameter of the furnace (e.g., as shown in FIG. 1), such that the interior lower wall portions forming the lip 15 at the bottom end of the collar are generally coplanar with interior wall surface portions of the furnace crucible 5.

The collar is further configured to engage with the furnace such that the bottom end of the collar rests upon a top surface of the furnace. The collar can be secured to the furnace utilizing any suitable fastening structure so as to removably secure the collar to the furnace. Alternatively, the collar can be permanently affixed to the furnace (e.g., via welding) or can even be formed integrally (e.g., formed as a single unit) with the furnace.

The collar includes an opening or port configured to receive the cryogenic liquid from a fluid supply source (e.g., a pressurized tank or vessel). The opening or port can be of any suitable type and configuration and be disposed at any one or more suitable locations along the collar so as to facilitate injection of the cryogenic liquid into the annular channel disposed at the bottom of the collar. In the embodiment of FIG. 1, an inlet port 16 in the form of an elongated pipe extends transversely from an exterior surface portion of the collar 10 to connect with a lance pipe 18 via fittings 20 or other suitable connecting structure. The lance pipe 18 can be of any suitable type and can further include any suitable phase separation device 22 disposed at its tip (e.g., a 40-80 μm diffuser) to ensure a substantially continuous flow of liquid cryogen emerges at a selected flow rate from the lance tip. The lance pipe 18 is connected to a liquid cryogen supply source 26 (e.g., a pressurized storage vessel). As noted above, the collar can be formed from stainless steel or other suitable materials. The lance pipe and connecting structure can also be formed of the same or similar materials.

As noted above, while any cryogenic liquid can be injected into the collar that is inert with respect to the metal material being processed (e.g., argon, nitrogen, carbon dioxide, etc.), argon is preferred because of its large expansion volume and high density with respect to air. In particular, argon can expand by increasing as much as 840 times its volume when vaporizing from liquid to gas at its vaporization temperature of about −302° F. (−185° C.). This is very useful in establishing a blanket of inert gas within the furnace as a result of the liquid argon vaporizing within the annular channel at the bottom of the collar.

The flow rate of liquid cryogen (e.g., liquid argon) from the lance into the collar channel can be selected based upon a number of factors for a particular application including, without limitation, the dimensions of the furnace, the surface area of the molten metal surface that is to be covered with cryogenic vapor, the reactivity of the alloy or metal that is being protected, the type of ventilation that is provided around the furnace (i.e., to draw oxygen and/or other gases away from the furnace), and the quality specifications of the metal product that is being produced in the furnace. Generally, a flow rate of liquid cryogen into the collar can be provided from about 0.002 lbs/in$^2$ and 0.005 lb/in$^2$ (about 0.14 g/cm$^2$ to about 0.35 g/cm$^2$) based upon the exposed metal surface area within the furnace. It is noted that the selection of a flow rate based upon the exposed metal surface area, rather than upon the volume of molten metal material, is different from conventional practice. In addition, the flow rate of liquid cryogen into the collar should be sufficient to ensure that a liquid ring of cryogen is developed and maintained within the channel at the bottom end of the collar so as to facilitate the continuous formation of a vapor ring that emerges from the collar and drops into the furnace during system operation.

During system operation, collar 10 is provided at the open top of the a furnace 4 in the manner noted above, and a lance pipe 18 is secured to the inlet port 16 of the collar to facilitate the flow of a cryogenic fluid (e.g., argon) from a fluid supply source 26 into annular channel 14 at the bottom of the collar. Metal materials to be melted are provided within the furnace crucible 5 and are heated to form a pool of molten metal 6 within the furnace.

At a selected time period during operation of the furnace, the cryogenic fluid is directed through lance pipe 18 at a controlled flow rate so as to form a ring of liquid 14 within channel 12. The flow rate is controlled such that the channel 12 remains filled with an annulus of cryogenic liquid and so that the liquid level remains below the height of the interior lip 15 of the collar. The cryogenic liquid vaporizes within the channel 12 to form an annulus of dense vapor or gas that passes over lip 15 and then falls along the peripheral wall portions within the crucible 5 toward the molten metal surface 8 (as generally shown by the dashed lines 30 in FIG. 1).

The dense vapor forms a vapor curtain around the peripheral interior wall portions of the furnace crucible, expanding outward toward the open center of the furnace upon reaching and/or as it falls toward the molten metal surface 8. The inert vapor displaces the less dense air and/or other gases away from the molten metal surface and forces these gases through the open top of the furnace (as generally indicated by lines 34 and arrow 36 in FIG. 1). In addition, upon reaching the molten metal surface, the vapor expands to cover the entire surface 8 (as generally indicated by lines 32 in FIG. 1), forming an effective blanket or layer of inert gas that covers the molten metal surface to inhibit or prevent oxygen and/or other gases from contacting and/or penetrating the molten metal material being processed within the furnace.

An expanding volume of inert gas is generated and maintained within the furnace in the manner noted above (i.e., with continuous plugs of vapor rings dropping along the peripheral wall portions of the furnace) by continuously flowing cryogenic liquid into the collar at the selected flow rate. The dense inert gas initially forces less dense gases such as oxygen and/or other gases from the furnace while forming an inert blanket or layer covering the molten metal surface. The continuous flow of inert liquid into the collar and vaporization to form inert gas flowing along the interior peripheral side wall portions of the furnace further facilitates maintenance of the inert gas layer within the furnace and inhibits or substantially prevents oxygen and/or other gases from flowing into the furnace and contacting the molten metal surface. In particular, the system is capable of reducing oxygen concentrations from about 0.5% to about 3% by volume at locations immediately above the molten metal surface (i.e., within the inert gas layer) while also reducing the concentrations of other gases (e.g., hydrogen) at such locations.

Thus, the system described above provides an effective delivery of an inert gas into a furnace or other container for blanketing or covering the surface of molten metal or other material being processed within the container. The system further utilizes less inert fluid than other conventional systems (e.g., systems in which a liquid layer of a cryogenic fluid such as argon is maintained over a molten metal surface). In addition, the system is safe in that it reduces the potential for "spitting" of molten metal material from a furnace since there is no direct contact between inert liquid and molten metal during the inerting or blanketing process.

It is noted that the invention is not limited to the system described above and depicted in FIGS. 1 and 2. Rather, the system can be modified in any suitable manner so long as it is capable of providing a generally continuous flow of inert gas into the container. Other systems can be designed to provide a generally continuous flow of inert gas into the container in an annular shape or substantially annular shape (e.g., a "C" shape, or in separate sections which combine to define a generally annular shape), where the system can be further configured such that the gas flow generally conforms with interior surface wall portions of the container as the inert gas flows toward the material being processed within the container.

For example, the collar of the system described above and shown in FIGS. 1 and 2 can be constructed of a series of separate, non-continuous sections rather than a single, continuous piece. The separate pieces can be disposed at distanced locations from each other along the top end of the container. In such an embodiment, each separate section would include its own inlet port to receive the inert fluid for delivery into the container. The separate pieces are oriented along the top of the furnace so as to form a substantially annular member or sectional collar. Each separate piece can be configured to generate a section of inert vapor that generally corresponds with an interior wall section of the container, such that each section combines to form a substantially annular vapor flowing into the container and substantially corresponding with the interior wall cross-sectional profile of the container. The vapor sections that are formed from the separate sections can expand as they fall within the container along the interior peripheral wall sections so as to form or substantially form a continuous vapor ring along the interior periphery of the container.

Figure 3:
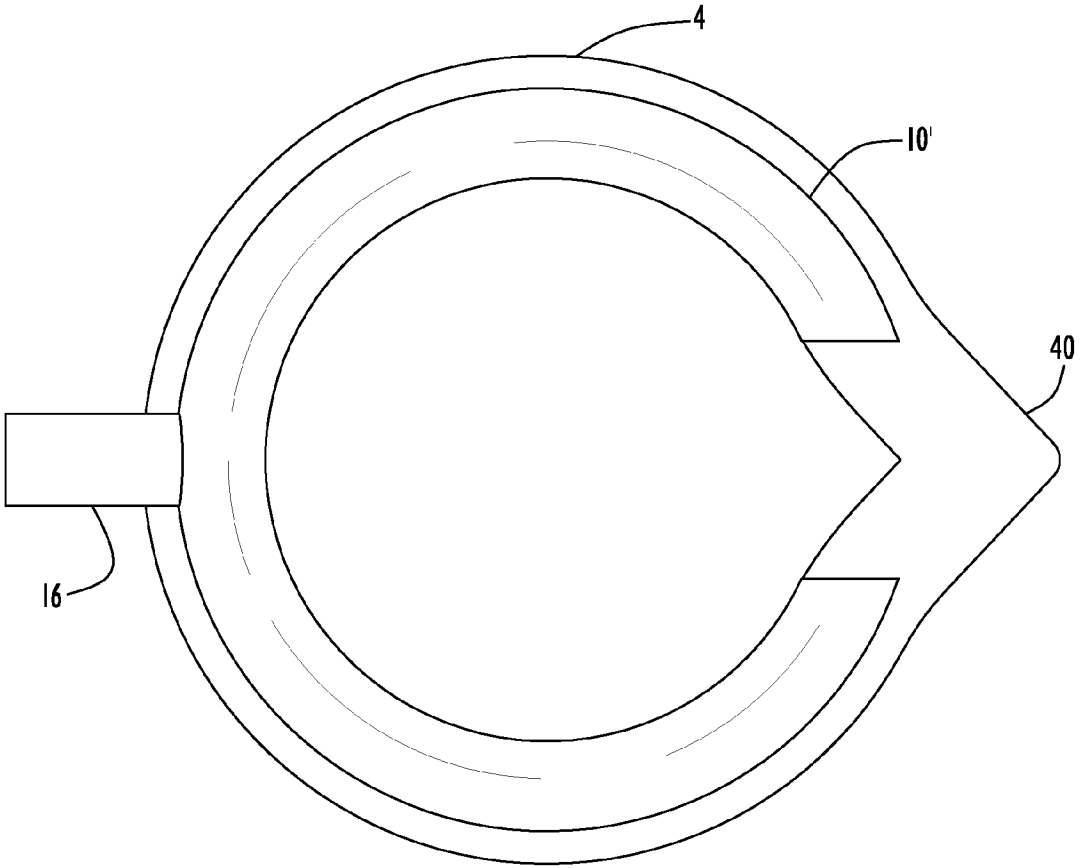
FIG. 3 is a top view of a molten metal furnace including another embodiment of a collar secured at the top end of the furnace, where the collar has an incomplete but substantially annular shape.

Alternatively, the collar can be configured as an incomplete or partially open but substantially annular member, such as a "C" shape, with the corresponding channel within the collar having the same or similar shape. An exemplary embodiment of a "C" shaped collar 10' is depicted in FIG. 3, wherein the "C" shaped collar is secured to a top end of a furnace 4. Such an embodiment is useful, for example, in rollover induction furnace systems that may include a pouring spout or lip (such as the pouring spout 40 shown in FIG. 3) or have any other configuration that makes it difficult or impossible to place a collar having a continuous or closed annular or ring shape such as is described in FIGS. 1 and 2 over the top surface of the furnace.

The corresponding substantially annular (e.g., "C" shaped) channel provides a curtain of vapor that is also substantially annular in shape and flows downward into the container toward the molten metal surface, where the downward flowing vapor is positioned proximate or along a major portion of the interior wall surface portions within the container (e.g., a major portion being 50% or greater of the transverse cross-sectional interior surface area of the container).

It is noted that the term "annular", as used herein with respect to the shape of the channel (or channel portions) formed in the collar (or in collar sections) and also the corresponding shape of the inert gas formed utilizing the system of the invention, refers to any shape in which a gas is formed by the system so as to generally conform with interior wall surface portions of a container with which the system is configured for engagement. For example, the annular channel may be round, oval, square, rectangular, multifaceted, etc. While the typical container with which the system would be used is a furnace or molten metal container having a generally cylindrical configuration, it is noted that the system can be readily modified for use with containers having non-cylindrical configurations (e.g., rectangular or multifaceted). In such scenarios, the collar and corresponding trough or channel provided within the collar can be configured to have the same or similar geometric configuration as a portion of or the entire cross-sectional configuration of the container. In a configuration in which a "C" shaped collar is provided for a generally rectangular container, the collar (and corresponding channel) can be configured to form a "C" shape with three generally linear sections (with corners at the connecting linear sections) instead of being a substantially continuous curved member.

While the annular or substantially annular configurations provide an effective flow of inert vapor within a container that rapidly forms an inert blanket or layer over the surface of the material being processed within the container, the system can also be effective having different configurations in which inert vapor is formed that is not annular or substantially annular in shape. Further, it is not required for the system to provide the inert vapor or gas such that the vapor flows along or proximate interior wall surface portions of the container.

An important feature in the systems described herein is to provide a suitable housing or other structure that includes a reservoir to receive and retain a cryogenic liquid, and to further include an opening that provides a fluid communication between the reservoir and the container interior to which the structure is secured, such that inert gas vaporizing from the cryogenic liquid can flow into the container to form the inert blanket over the surface of material processed within the container. It is further important to ensure that the liquid retained within the reservoir does not leave the reservoir, but rather that the system is designed to facilitate vaporization of the liquid to the inert vapor or gas which can then leave through the opening in the system so as to enter and fall within the container toward the material surface.

Providing a system with a suitable configuration to achieve these features (such as the systems described above) facilitates an efficient use of cryogenic fluid that can be provided in considerably smaller amounts in comparison to conventional systems (such as conventional systems which blanket a molten metal surface within a furnace with an inert gas). Further, providing such features ensures that the material surface within the container is contacted with inert gas rather than liquid. In scenarios in which the material being processed is molten metal within a furnace, the contact of the molten metal surface with inert gas rather than a liquid limits or prevents the possibility of "spitting" of molten metal material from the furnace.

Having described a novel system and corresponding method for producing an inert blanket in a furnace, it is believed that other modifications, variations and changes will be suggested to those skilled in the art in view of the teachings set forth herein. It is therefore to be understood that all such variations, modifications and changes are believed to fall within the scope as defined by the appended claims.

The invention claimed is:

1. A system for delivering a fluid into a container, the system comprising:

a housing configured to be secured to the container and further including a reservoir to receive and retain a fluid as a liquid, wherein the housing further includes a collar including a central opening extending through the collar between a top end and a bottom end of the collar, and a channel annular or substantially annular in shape defined within an interior of the collar near the bottom end, the bottom end of the collar including an interior surface that extends upward toward the top end of the collar so as to form a lip having an end that terminates between the top and bottom ends, the lip defining a portion of the channel, the channel being in fluid communication with the central opening, the central opening providing fluid communication between the reservoir and an interior within the container so as to facilitate a flow of gas which is formed from vaporization of the liquid within the reservoir into the container interior.

2. The system of claim 1, wherein the inlet port comprises an elongated pipe extending transversely from an exterior side wall portion of the collar.

3. The system of claim 1, further comprising a lance pipe that is connected with the inlet port, wherein the pipe is configured to deliver the fluid in the form of a liquid through the inlet port and into the collar.

4. The system of claim 3, further comprising a fluid source connected with the lance pipe.

5. The system of claim 4, wherein the fluid source is adapted to contain at least one of liquid argon, liquid nitrogen and liquid carbon dioxide.

6. The system of claim 4, wherein the fluid source is adapted to contain liquid argon.

7. The system of claim 3, wherein the bottom end of the collar includes an interior surface that extends upward toward the top end of the collar so as to form a lip having an end that terminates between the top and bottom ends, and the lip defines a portion of the channel.

8. The system of claim 1, wherein at least one of the collar and the inlet port is constructed of one or more materials, at least one of the materials comprising stainless steel.

9. The system of claim 1, wherein the collar has a continuous, annular shape that defines a corresponding continuous, annular shape for the channel.

10. The system of claim 1, wherein the collar is curved and has a C shape with two terminal ends proximate each other so as to define a corresponding C shape for the channel.

11. A metal processing system comprising:

a container including an opening at a top end of the container, the container being configured to retain a molten metal product within the container; and the system of claim 1, wherein the system is secured to the container such that the housing is disposed on the top end of the container with the opening of the housing being in fluid communication with the opening at the top end of the container.

12. The metal processing system of claim 11, wherein the housing comprises a collar including an opening extending through the collar between a top end and a bottom end of the collar, and a channel defined within an interior of the collar near the bottom end, wherein the channel is annular or substantially annular in shape and is in fluid communication with the opening, and the system further comprises:

an inlet port configured to receive the fluid as a liquid and deliver the fluid into the channel.

13. The metal processing system of claim 11, wherein the container comprises an induction furnace configured to heat a solid metal material to from the molten metal product within the furnace.

14. The metal processing system of claim 12, wherein the bottom end of the collar includes an interior surface that extends upward toward the top end of the collar so as to form a lip having an end that terminates between the top and bottom ends, and the lip defines a portion of the channel.

15. The metal processing system of claim 12, further comprising a lance pipe that is connected with the inlet port, wherein the pipe is configured to deliver the fluid in the form of a liquid through the inlet port and into the collar.

16. The metal processing system of claim 15, further comprising a fluid source connected with the lance pipe, wherein the fluid source is adapted to contain at least one of liquid argon, liquid nitrogen and liquid carbon dioxide.

17. A system for delivering a fluid into a container, the system comprising:

a means for receiving the fluid as a liquid and for delivering the fluid into the container as a vapor; and an inlet port configured to provide the fluid as a liquid to the means for delivering the fluid into the container.

18. The system of claim 17, wherein the means for receiving the fluid as a liquid and for delivering the fluid into the container as a vapor is configured to deliver the vapor into the container such that the vapor has a shape that conforms and corresponds with a major portion of a cross-sectional shape defined by interior peripheral wall portions of the container.

19. The system of claim 17, wherein the means for receiving the fluid as a liquid and for delivering the fluid into the container as a vapor is configured to deliver the vapor into the container in an annular or substantially annular shape.

20. The system of claim 17, further comprising a fluid delivery source connected to the inlet port, wherein the fluid source is adapted to contain at least one of argon, nitrogen and carbon dioxide that is contained within the fluid delivery source.

21. A method of providing a vapor layer over a material processed within a container, the method comprising:

delivering a fluid as a liquid into a housing disposed proximate an opening in the container, wherein the housing is configured to facilitate vaporization of the liquid to form a continuous flow of vapor from the housing into the container; and facilitating a downward flow of the vapor within the container toward the material being processed within the container;

wherein the vapor formed from the fluid in the housing is inert with respect to the material being processed within the container.

22. The method of claim 21, wherein the housing is configured to facilitate the formation of a vapor having an annular or substantially annular shape within the container, and the vapor is provided in a suitable amount within the container and is further configured to expand as the vapor flows toward surface portions of the material in the container so as to form a vapor layer at a location proximate the material that substantially covers the surface portions of the material.

23. The method of claim 22, wherein the housing comprises a collar that is disposed at a top end of the container, the collar including an opening extending through the collar between a top end and a bottom end of the collar, and a channel having an annular or substantially annular shape defined within an interior of the collar near the bottom end, wherein the channel is in fluid communication with the opening, and the delivery of the fluid into the collar comprises:

injecting the fluid as a liquid into the channel via an inlet port that is connected with the collar, wherein the fluid vaporizes to form the vapor having an annular or substantially annular shape that flows into the container.

24. The method of claim 23, wherein the bottom end of the collar includes an interior surface that extends upward toward the top end of the collar so as to form a lip having an end that terminates between the top and bottom ends, the lip defines a portion of the channel, and the vapor passes over the lip and flows into the container.

25. The method of claim 23, wherein the collar has a continuous, annular shape that defines a corresponding continuous, annular shape for the channel.

26. The method of claim 23, wherein the collar is curved and has a C shape with two terminal ends proximate each other so as to define a corresponding C shape for the channel.

27. The method of claim 23, wherein the fluid is injected into the channel with a lance pipe that is connected with the inlet port.

28. The method of claim 27, further comprising:

providing the fluid as a liquid to the lance pipe via a fluid supply source.

29. The method of claim 28, wherein the fluid supply source contains at least one of liquid argon, liquid nitrogen and liquid carbon dioxide.

30. The method of 28, wherein the container comprises an induction furnace, and the material comprises molten metal.

31. The method of claim 21, wherein the container comprises an induction furnace, and the material comprises molten metal.

32. The method of 31, wherein the fluid comprises at least one of argon, nitrogen and carbon dioxide.

* * * * *